US007578084B2

(12) United States Patent
Wu

(10) Patent No.: US 7,578,084 B2
(45) Date of Patent: Aug. 25, 2009

(54) IDENTIFICATION DEVICE FOR A GOLF CLUB HEAD COVER

(76) Inventor: Chiawen Wu, 7800 Penny Lane, Richmond, BC (CA) V6Y 2Z1

( * ) Notice: Subject to any disclaimer, the term of this patent is extended or adjusted under 35 U.S.C. 154(b) by 278 days.

(21) Appl. No.: 11/563,228

(22) Filed: Nov. 27, 2006

(65) Prior Publication Data

US 2008/0108455 A1 May 8, 2008

(30) Foreign Application Priority Data

Nov. 6, 2006 (CN) ..... 2006 2 0015625

(51) Int. Cl.
*G09F 3/20* (2006.01)

(52) U.S. Cl. ..... 40/495; 40/915

(58) Field of Classification Search ..... 40/495; 150/160; 74/10.15, 10.2, 10.41; 473/287; 116/222, 223, 311, 315, 318, 279; 235/1 C
See application file for complete search history.

(56) References Cited

U.S. PATENT DOCUMENTS 3,828,285 A * 8/1974 Yokoyama et al. ..... 334/14
5,730,658 A * 3/1998 Kurtz et al. ..... 473/205
2008/0222931 A1* 9/2008 Wu ..... 40/493
2008/0222933 A1* 9/2008 Wu ..... 40/642.02
2008/0223284 A1* 9/2008 Wu ..... 116/315

* cited by examiner

*Primary Examiner*—Joanne Silbermann
(74) *Attorney, Agent, or Firm*—Matthias Scholl P.C.; Matthias Scholl

(57) ABSTRACT

Taught herein is an identification device for golf club head covers comprising an outer shell having a front cover and a back cover; a window for displaying identifying indicia disposed on said front cover; a disk bearing a plurality of identification indicia; means for rotating the disk intermittently so that the identifying indicia are displayed through the window, one indicium at a time, the means being disposed within said outer shell; and means for connecting the identification device to a golf club head cover. Since a plurality of different identification indicia can be displayed at a push of a button, a convenient and easy to use identification device for golf club head covers is realized.

8 Claims, 3 Drawing Sheets

IDENTIFICATION DEVICE FOR A GOLF CLUB HEAD COVER

BACKGROUND OF THE INVENTION

1. Field of the Invention

This invention relates to identification devices for golf club head covers, and more particularly, to identification devices by means of which displayed identification indicia can be changed on demand.

2. Description of the Related Art

As is well known to those skilled in the art, golf clubs are protected by head covers when not in use. Conventional golf club head covers include a head portion to protect the head of a golf club and a body portion to protect the shaft of a golf club. Generally, the head portion is knitted from good flannel material, while the body portion is fabricated from an elastic material having the shape of a long cylinder.

When a head cover is put over a golf club, the head of the club is covered completely and so, it is generally difficult to identify the club correctly and easily. To solve this problem, head covers can be permanently marked with various indicia on the outside surface. However, in this way, rather than being interchangeable, one head cover can only be matched to and used with one corresponding club type. This is costly and inconvenient.

Additionally, head covers can be marked on the outside surface with detachable identification tags. In this way, one head cover can be shared among various clubs. However, it is largely inconvenient to carry multiple identification tags which can be easily misplaced, or lost.

SUMMARY OF THE INVENTION

In view of the foregoing, it is one objective of the invention to provide an identification device for golf club head covers having a plurality of indicia marked thereon which indicia can be easily interchanged on demand.

To achieve the above objective, provided is an identification device for a golf club head cover comprising: an outer shell having a front cover and a back cover; a window for displaying identifying indicia disposed on the front cover; a disk bearing a plurality of identification indicia; means for rotating the disk intermittently so that the identifying indicia are displayed through the window, one indicium at a time, the means being disposed within the outer shell; and means for connecting the identification device to a golf club head cover.

In a one embodiment, the means for rotating the disk comprises a pushbutton; a driving member; and a pushbutton reset apparatus; a plurality of driving teeth is disposed and distributed evenly on the pushbutton; a plurality of driving notches is disposed and distributed evenly on the driving member; the driving teeth can be aligned with the driving notches so as to cooperate in driving the driving member and to rotate the disk intermittently; the pushbutton reset apparatus is disposed between the driving member and the outer shell; a via hole is disposed in a central position of the front cover, the pushbutton projects over the via hole; a plurality of stop blocks is disposed on the inner circumference of the via hole; and the driving member does not rotate circumferentially relative to the disk.

In another embodiment, the means for rotating the disk comprises a pushbutton; a driving member; and a pushbutton reset apparatus; a plurality of driving teeth is disposed and distributed evenly on the pushbutton; a plurality of driving notches is disposed and distributed evenly on the driving member; the driving teeth can be aligned with the driving notches so as to cooperate in driving the driving member and to rotate the disk intermittently; the pushbutton reset apparatus is disposed between the driving member and the outer shell; a via hole is disposed in a central position of the back cover, the pushbutton projects over the via hole; a plurality of stop blocks is disposed on the inner circumference of the via hole; and the driving member does not rotate circumferentially relative to the disk.

In certain classes of the embodiments, the front cover and the back cover are joined by a plurality of screws.

In certain classes of the embodiments, the pushbutton reset apparatus comprises a compression spring and a slip member connected to one end of the compression spring.

In certain other classes of the embodiment, the means for connecting the identification device to a golf club head cover is a metal plate having a slit through which a strip of material can be passed and connected back to the golf club head cover.

Since a plurality of different identification indicia is provided in one convenient and simple to use identification device, and the identification indicia displayed can be changed easily by a user according to demand at a push of a button, the goal set out to accomplished has been realized.

DETAILED DESCRIPTION OF THE INVENTION

Figure 1:
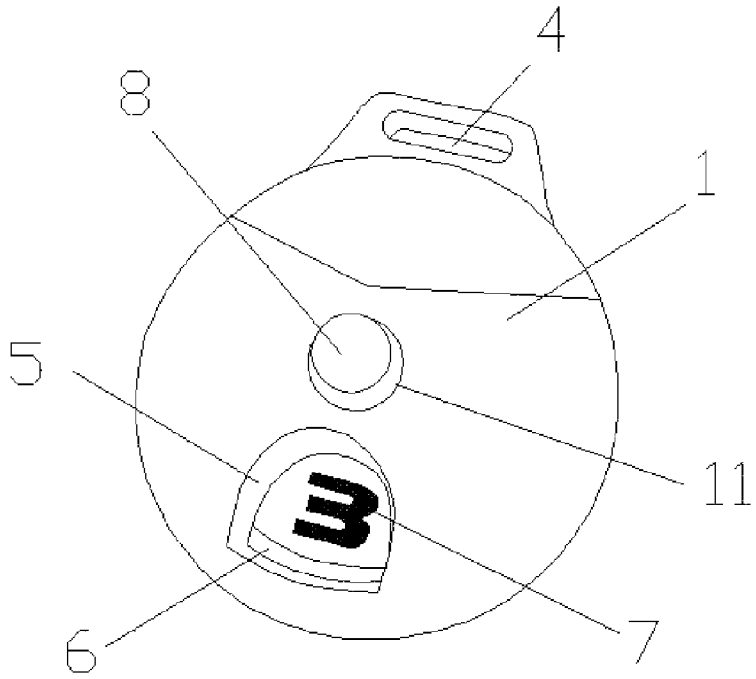
FIG. 1 illustrates a top perspective view of an identification device in accordance with the first embodiment of the present invention.
Figure 2:
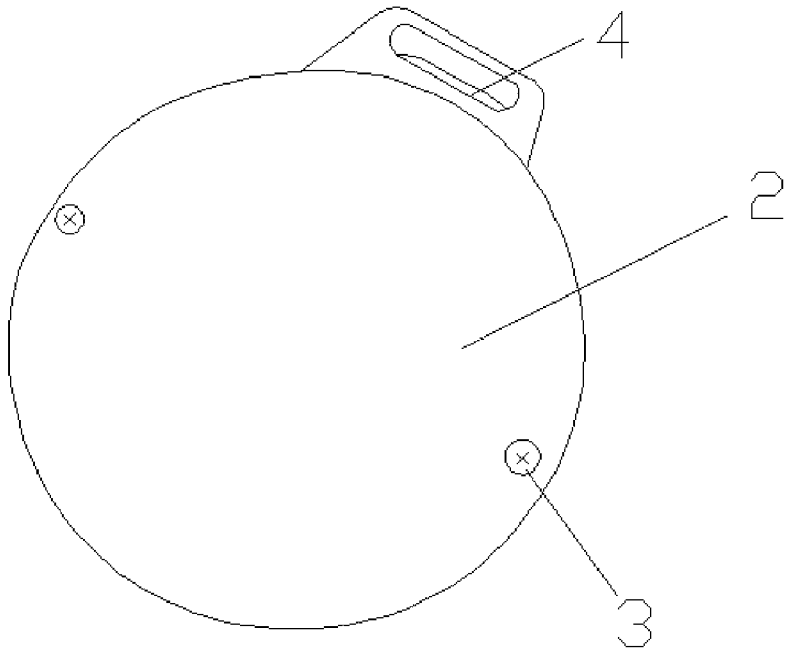
FIG. 2 illustrates a bottom perspective view of an identification device in accordance with the first embodiment of the present invention.
Figure 3:
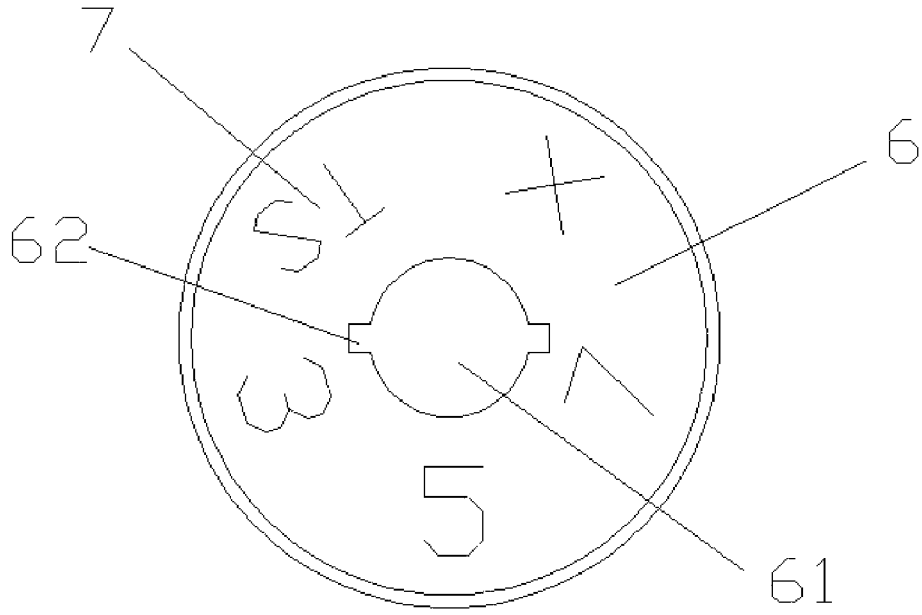
FIG. 3 illustrates a top plan view of a disk in accordance with the first embodiment of the present invention.
Figure 4:
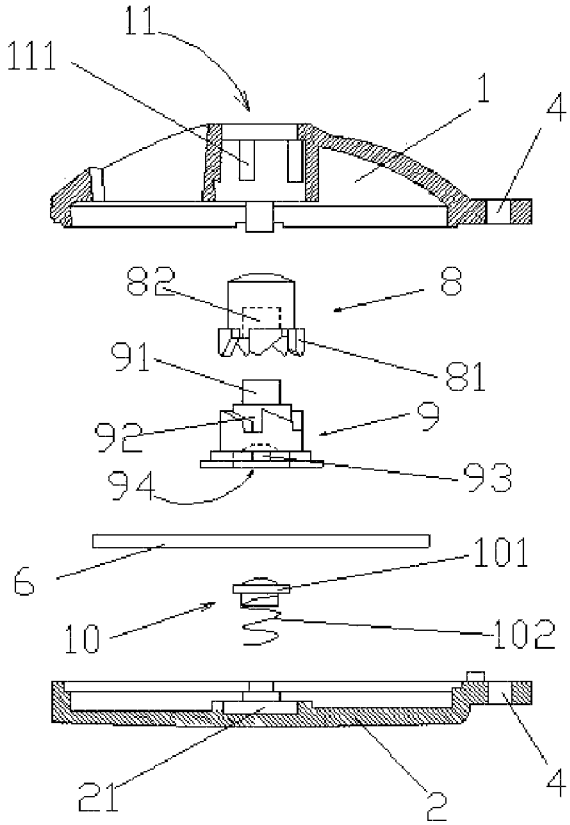
FIG. 4 illustrates an exploded view of an identification device in accordance with the first embodiment of the present invention.

With reference to FIGS. 1-4, an identification device in accordance with a first embodiment of the present invention comprises (a) an outer shell consisting of a front cover 1 and a back cover 2 which are connected to each other by a plurality of screws 3; (b) means 4 for connecting the identification device to a golf club head cover, disposed on the edge of the outer shell; (c) a window 5 for displaying identifying indicia disposed on the front cover 1; (d) a disk 6 that can be rotated intermittently; and (e) a rotary driving device connected to the disk 6 set within the outer shell.

Preferably, the means 4 for connecting the identification device to a golf club head cover is a metal protrusion or plate or a plurality of metal protrusions or plates having one or more elongated slits through which a cloth strip attached to a golf club head cover can be passed and secured back onto the golf club head cover by means of a detachable connection such as buckle, Velcro, etc.

A plurality of identifying indicia 7 is marked and is distributed circumferentially on the disk 6. A via hole 61 is disposed at the central position of the disk 6. The via hole 61 includes a pair of restriction slots located at opposite sides of the via hole.

The identification indicia are displayed orderly through the window on the front cover of the outer shell when the disk is being rotated intermittently, and only one indicium, e.g., a number and/or a letter, can be displayed at a time.

A rotary driving device rotating the disk intermittently so that the identifying indicia are displayed through the window, one indicium at a time, is connected to the disk 6. The rotary driving device comprises a pushbutton 8; a driving member 9; and a pushbutton reset apparatus 10. A plurality of driving teeth 81 is set and distributed evenly on the lower portion of the pushbutton 8. A positioning bar 91 that can be inserted into the pilot hole 82 at the lower portion of the pushbutton 8 projects over the top surface of the driving member 9. A plurality of driving notches 92 that can be geared with the driving teeth 81 is set and distributed evenly in the middle portion of the driving member 9. An internal cavity 94 that accommodates a slip member 101 at the upper portion of the pushbutton reset apparatus 10 is formed on the bottom surface of the driving member 9. The bottom peripheral edge of the driving member 9 is flanged, and a pair of stop blocks 93 located opposite relative to each other are set on the flange of the driving member 9. The two stop blocks are matched respectively with said two restrict slots 62 so that the driving member 9 does not rotate circumferentially relative to the disk 6. The driving teeth 81 at the lower portion of the pushbutton 8 are geared with the driving notches 92 of the driving member 9 so that the driving member 9 and the disk 6 can rotate intermittently when the pushbutton 8 is pushed externally by a golfer.

The pushbutton reset apparatus 10 comprises a compression spring 102 and a slip member 101 connected to the front end of the compression spring 102, and is located between the internal cavity 94 at the bottom surface of the driving member 9 and the central slot 21 on the inner surface of the back cover 2 of the outer shell. A via hole 11 is disposed at the central position of the front cover 1 of the outer shell. The pushbutton 8 projects over the via hole. A plurality of stop blocks 111 for restricting the rotation of the pushbutton 8 is set on the inner circumference of the via hole 11.

Under normal conditions, the operation of the rotary driving device is as follows. The top end of the pushbutton 8 projects over the via hole 11. By pressing the pushbutton 8, the driving teeth 81 at the lower portion of the pushbutton are geared with and then rotate relative to the driving notches 92 of the driving member 9. The pushbutton 8 does not rotate under the function of the stop blocks 111. The driving member 9 is fixed circumferentially relative to the disk 6 through the gear of the two stop blocks 93 by the two restrict slots 62. This is to say that the driving member 9 and the disk 6 do not rotate circumferentially relative to each other. Therefore, when the pushbutton 8 is pressed down, the driving member 9 and the disk 6 will rotate a certain angle around the central axis of rotation that is also the axis of symmetry of several symmetric elements of the rotary driving device. When the external (human) force applied to the pushbutton 8 is removed, i.e., the pushbutton is released, it bounces under the spring recoil force supplied by the pushbutton reset apparatus 10, and in the meantime, the driving member 9 and the disk 6 rotate through a certain angle so as to display exactly the next identification indicium in the row through the display window 5 on the front cover of the outer shell. The change of the identification indicia displayed is thereby realized. By repeating the above steps, a different identification indicium disposed on the disk 6 is displayed.

Figure 5:
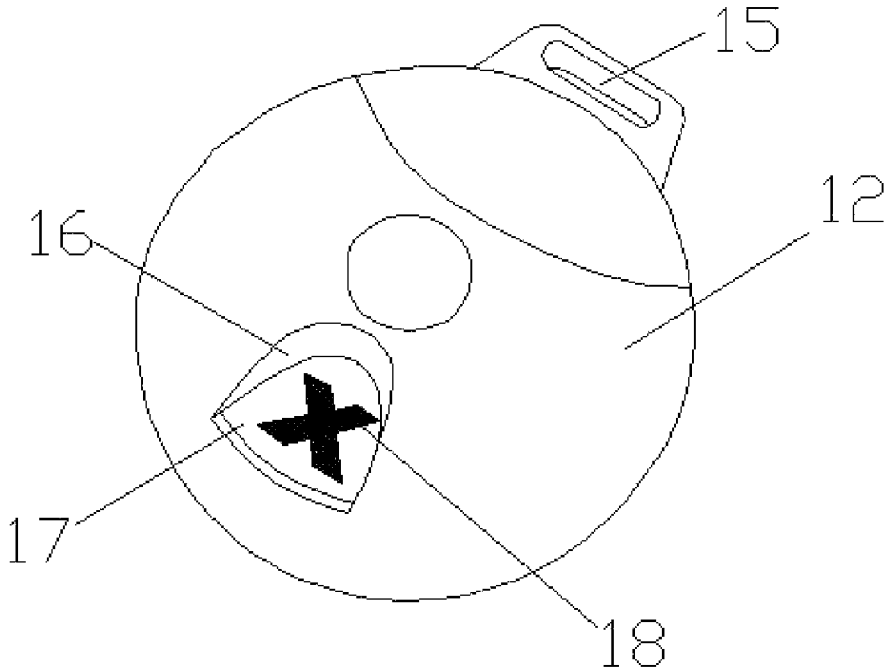
FIG. 5 illustrates a top perspective view of an identification device in accordance with a second embodiment of the present invention.
Figure 6:
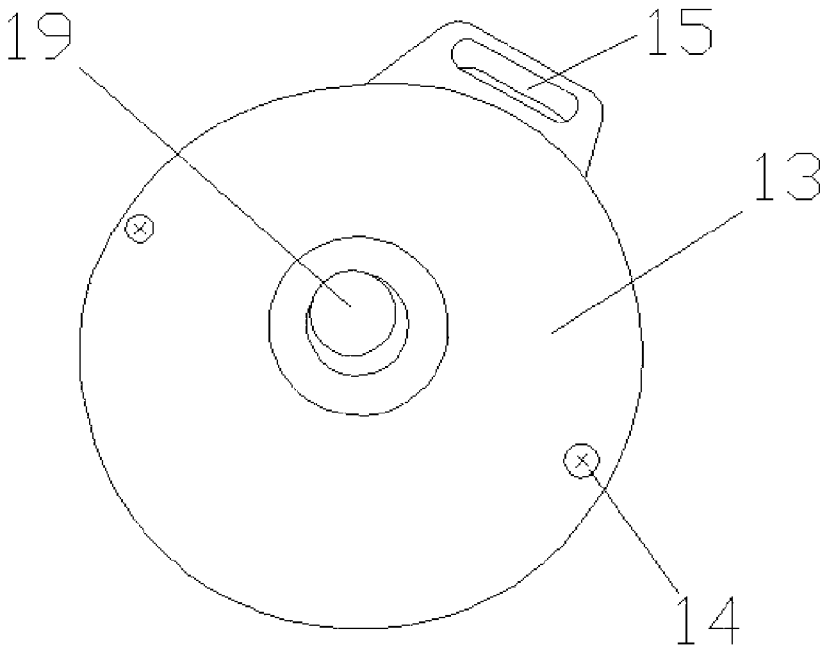
FIG. 6 illustrates a bottom perspective view of an identification device in accordance with a second embodiment of the present invention.

With reference to FIGS. 5-6, an identification device for golf club head cover in accordance with a second embodiment of the present invention comprises (a) an outer shell consisting of a front cover 12 and a back cover 13 which are connected to each other by a plurality of screws 14; (b) means 15 for connecting the identification device to a golf club head cover, disposed on the edge of the outer shell; (c) a window 16 for displaying identifying indicia disposed on the front cover 12; (d) a disk 17 that can be rotated intermittently; and (e) a rotary driving device connected to the disk 6 set within the outer shell Preferably, the means 15 for connecting the identification device to a golf club head cover is a metal protrusion or plate or a plurality of metal protrusions or plates having one or more elongated slits through which a cloth strip attached to a golf club head cover can be passed and secured back onto the golf club head cover by means of a detachable connection such as a buckle, Velcro, etc.

A plurality of identifying indicia 18 is marked and distributed circumferentially on the disk 17. The identification indicia are displayed orderly through the window on the front cover of the outer shell when the disk is being rotated intermittently, and only one indicium is displayed though the window at a time.

The rotary driving device connected to the disk 17 includes a pushbutton 19; a driving member; and a pushbutton reset apparatus. However, as distinguished from the first embodiment, in the second embodiment, a via hole 11 is disposed at the central position of the back cover 13 of the outer shell (rather than the font cover 1 as in the first embodiment), and the pushbutton 19 projects over the via hole.

A plurality of stop blocks for restricting the rotation of the pushbutton 19 and a plurality of pilot slots are set on the inner circumference of the via hole 11. The driving member does not rotate circumferentially relative to the disk 17, the pushbutton 19 is matched with the bottom end of the driving member so as to drive the driving member and the disk 17 rotate intermittently. The pushbutton reset apparatus is a compression spring located between the top end of the driving member and the inner surface of the front cover 12 of the outer shell.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. An identification device for a golf club head cover comprising:

an outer shell having a front cover and a back cover;

a window for displaying identifying indicia disposed on said front cover;

a disk bearing a plurality of identification indicia;

means for rotating said disk intermittently so that said identifying indicia are displayed through said window, one indicium at a time, said means being disposed within said outer shell; and means for connecting the identification device to a golf club head cover, wherein said means for rotating said disk comprises a pushbutton; a driving member; and a pushbutton reset apparatus;

a plurality of driving teeth is disposed and distributed evenly on said pushbutton;

a plurality of driving notches is disposed and distributed evenly on said driving member;

said driving teeth can be aligned with said driving notches so as to cooperate in driving said driving member and to rotate said disk intermittently;

said pushbutton reset apparatus is disposed between said driving member and said outer shell;

a via hole is disposed in a central position of said front cover, said pushbutton projects over said via hole;

a plurality of stop blocks is disposed on the inner circumference of said via hole; and said driving member does not rotate circumferentially relative to said disk.

2. The device of claim 1, wherein said front cover and said back cover are joined by a plurality of screws.

3. The device of claim 1, wherein said pushbutton reset apparatus comprises a compression spring and a slip member connected to one end of the compression spring.

4. The device of claim 1, wherein said means for connecting the identification device to a golf club head cover is a metal protrusion having a slit through which a strip of material can be passed and connected back to the golf club head cover.

5. An identification device for a golf club head cover comprising:

an outer shell having a front cover and a back cover;

a window for displaying identifying indicia disposed on said front cover;

a disk bearing a plurality of identification indicia;

means for rotating said disk intermittently so that said identifying indicia are displayed through said window, one indicium at a time, said means being disposed within said outer shell; and means for connecting the identification device to a golf club head cover, wherein said means for rotating said disk comprises a pushbutton; a driving member; and a pushbutton reset apparatus;

a plurality of driving teeth is disposed and distributed evenly on said pushbutton;

a plurality of driving notches is disposed and distributed evenly on said driving member;

said driving teeth can be aligned with said driving notches so as to cooperate in driving said driving member and to rotate said disk intermittently;

said pushbutton reset apparatus is disposed between said driving member and said outer shell;

a via hole is disposed in a central position of said back cover, said pushbutton projects over said via hole;

a plurality of stop blocks is disposed on the inner circumference of said via hole; and said driving member does not rotate circumferentially relative to said disk.

6. The device of claim 5, wherein said front cover and said back cover are joined by a plurality of screws.

7. The device of claim 5, wherein said pushbutton reset apparatus comprises a compression spring and a slip member connected to one end of the compression spring.

8. The device of claim 5, wherein said means for connecting the identification device to a golf club head cover is a metal protrusion having a slit through which a strip of material can be passed and connected back to the golf club head cover.

* * * * *